United States Patent [19]

Hatch

[11] 4,375,869

[45] Mar. 8, 1983

[54] PROTECTIVE COVERS OR ENCLOSURES FOR MAILBOXES

[76] Inventor: Gary H. Hatch, 590 Diane Cir., Casselberry, Fla. 32707

[21] Appl. No.: 185,256

[22] Filed: Sep. 8, 1980

[51] Int. Cl.[3] ..... B65D 91/00

[52] U.S. Cl. ..... 232/17; 109/49.5; 217/51

[58] Field of Search ..... 220/449, 400; 217/3 R, 217/51; 150/52 R; 248/145; 109/49.5; 232/17

[56] References Cited

U.S. PATENT DOCUMENTS

| | | | |
|---|---|---|---|
| D. 166,749 | 5/1952 | Heinz . | |
| 722,423 | 3/1903 | Greenstreet | 217/51 |
| 938,041 | 10/1909 | Cosgrove et al. | 217/51 |
| 1,411,867 | 4/1922 | Munson | 248/145 |
| 2,326,713 | 8/1943 | Wesseler | 109/49.5 X |
| 2,642,542 | 6/1953 | Weinberg | 109/49.5 |
| 3,107,848 | 10/1963 | Penta . | |
| 3,848,508 | 11/1974 | Bullinger | 109/49.5 X |
| 4,187,978 | 2/1980 | Dowker | 248/145 X |
| 4,244,512 | 1/1981 | Wise | 232/17 |

*Primary Examiner*—Francis K. Zugel
*Assistant Examiner*—Peter A. Aschenbrenner
*Attorney, Agent, or Firm*—Roger L. Martin

[57] ABSTRACT

A rural mailbox cover has a slat assembly which overlays the arcuate roof and opposite side walls formed by a center panel of the mailbox, the assembly having parallel slats of equal lengths which are arranged in a row and joined by elongated flexible and preferably resiliently extensible elements that extend transversely of the row of slats and are fixed to each slat at the interiorly facing side of the assembly. A center group of slats are beveled at their opposite side edges to facilitate a contiguous slat edge arrangement for the group as they overlay the arcuate roof of the mailbox and the opposite ends of each slat are beveled to accommodate the location of the door flange and a bead at the juncture of the center and rear wall panels of the mailbox. The opposite end panels of the mailbox are covered by components that have a plate with a decorative strip that forms a flange that projects inwardly to overlay the adjacent ends of the slats in the slat assembly.

10 Claims, 9 Drawing Figures

PROTECTIVE COVERS OR ENCLOSURES FOR MAILBOXES

BACKGROUND OF THE INVENTION

The invention relates to protective enclosures or covers for mailboxes.

The conventional mailbox is a well known fixture in rural America and is a constant target for objects thrown by vandals from moving vehicles. The conventional mailbox, being made of sheet metal panels that form an arcuate roof, has at the outset a normally drab appearance, as far as many people are concerned. As installed, it becomes the target of objects thrown from passing automobiles and with use, it becomes progressively more unsightly as the sheet metal panels are dented and deformed by each encounter with a thrown object.

Many residence provide a decorative enclosure or cover for their mailbox. In addition to improving the aesthetics of the structure, such enclosures serve to protect the mailboxes from thrown objects and seemingly also serve to deter such acts of vandalism.

Most mailbox enclosures are made from wooden material and are either designed and assembled by the resident or are purchased locally as a substantially fully assembled structure in which the mailbox is inserted during installation. Very few mailbox enclosures are sold in kit form for assembly by the purchaser because most designs embody a simple box-like structure with either a sloping or peaked roof and people are generally reluctant to pay a premium price for a few precut wooden boards that then have to be assembled into a finished structure which for all intents and purposes can be assembled from materials that are readily available and easily cut with the aid of conventional household tools. The conventional designs are also expensive to ship in kit form because of the weight of the materials and it should be apparent to those skilled in the art that any reduction in the amount of material used not only saves shipping costs but also the basic cost of materials involved.

SUMMARY OF THE INVENTION

The invention contemplates a protective enclosure or cover for conventional mailboxes of the kind with an arcuate roof forming panel and which includes a slat assembly or component that is simply draped over and secured to the center panel of the mailbox as the protective enclosure is attached to the structure. In addition to the slat assembly, the enclosure includes a pair of components that are adapted to overlay the exterior surfaces of the rear and door panels of the mailbox.

The slat assembly includes a plurality of elongated slats of equal length and which are assembled in a row and secured to gether in a parallel arrangement with at least a pair of flexible members that extend transversely of the slats and are secured to each slat in the assembly. The slat assembly has a center group of slats which have beveled side edges that facilitate their adaptation to the arcuate roof of the mailbox and each slat is provided with an inclined surface at its opposite ends so as to accommodate the normal position for the door panel when it is closed as well as a bead that is formed at the juncture between the rear wall and center panels used in the structure of the mailbox. The end panel covering components are somewhat larger than but nevertheless generally conformed to the cross-sectional contour of the mailbox and each is provided with a flange component that normally overlies the adjacent ends of the slats of the assembly when the mailbox is closed.

Because the slat assembly follows the contour of the center panel, a reduction in material usage is realized over conventional designs. The use of flexible materials to secure the slats together in the assembly facilitates a conformation of the slat assembly to the contour of the center panel of the mailbox and also permits the assembly to be folded upon itself for compactness during shipping in a kit form. In the preferred form, such flexible members are also resiliently extensible and are so-attached to the slats under tension that the edges of the slats are continuously urged together into a touching relation.

A general object of the invention is to provide an improved protective cover or enclosure for conventional rural mailbox structures. Yet another object is to provide a protective cover that may be marketed in kit form and readily installed by a purchaser using conventional household tools. Another object is to provide a protective enclosure for mailboxes and which reduces the amount of covering material required in comparison to more conventional enclosure designs. Still a further object is to provide an inexpensive protective enclosure for conventional rural mailboxes and which may be marketed in a kit form having a component that is not readily reproduced through the use of conventional household tools but which is nevertheless readily installed by such tools.

DESCRIPTION OF THE DRAWINGS

The novel features which are believed to be characteristic of this invention are set forth with particularity in the appended claims. The invention, itself, however, both as to its organization and method of operation, together with further objects and advantages thereof, may best be understood by reference to the following descriptions taken in connection with the accompanying drawings, wherein:

DESCRIPTION OF PREFERRED EMBODIMENTS

Figure 1:
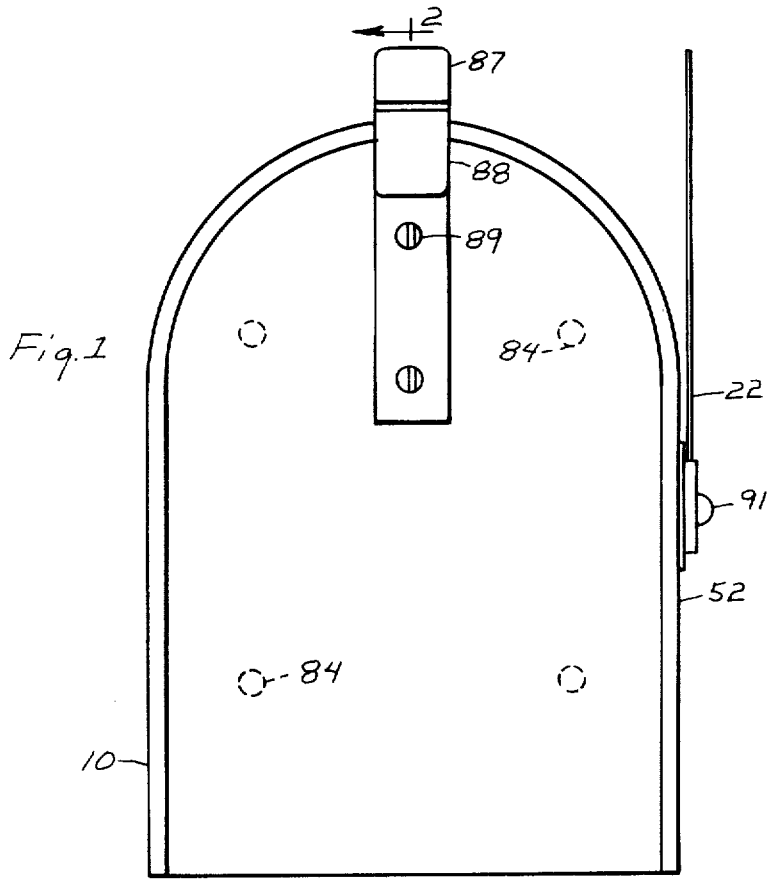
FIG. 1 is a front end view of a mailbox which is protected by an enclosure or mailbox cover embodying the principles of the invention.
Figure 2:
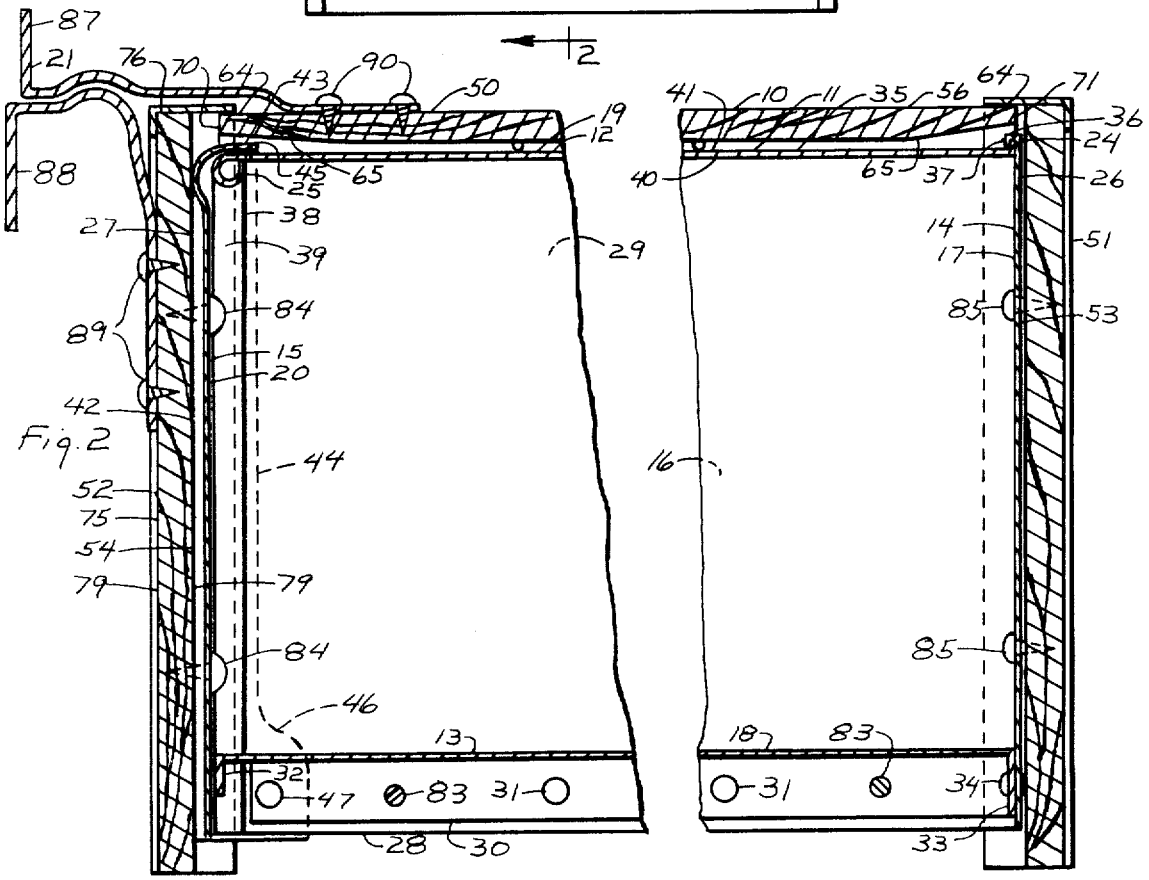
FIG. 2 is a longitudinal sectional view through the mailbox and its cover as taken generally along the Lines 2—2 of FIG. 1, with certain medial parts of the structure being broken away.
Figure 3:
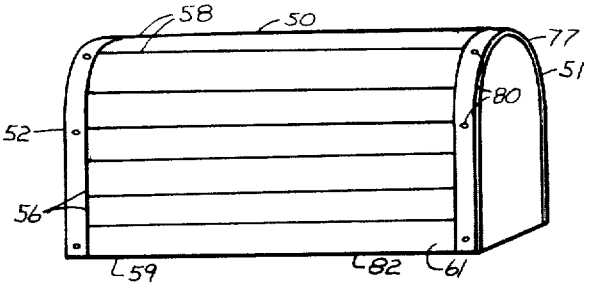
FIG. 3 is an isometric view on a reduced scale of the structure seen in FIGS. 1 and 2 before the addition of the latch and flag assemblies.

Reference is now made to the drawings and wherein a mailbox enclosure or cover embodying the principles of the invention is designated at 10 and is seen in FIGS. 1 and 2 as mounted on a conventional rural mailbox 11.

The mailbox has a center panel 12, a floor panel 13, and opposite end panels 14 and 15. These panels 12–15 are made from sheet metal and are assembled to form the upright opposite side walls 16 and rear walls 17 of the mailbox 11, as well as the floor 18, roof 19 and front door 20 thereof. The mailbox 11 has a conventional latch mechanism 21 and a flag assembly 22 which as seen in FIGS. 1 and 2 have been removed from the mailbox 11 per se and reattached to components of the mailbox cover 10.

The center panel 12 is a generally rectangular member with opposite edge portions 24 and 25 at the rear and front ends 26 and 27 of the mailbox and with opposite lateral side edge portions 28 at the opposite sides of the mailbox. Between the lateral side edge portions 28, the panel 12 is bent to provide the arcuate roof 19 and the upright opposite side walls 16 of the mailbox. In this arrangement, the side walls 16 are spaced apart in a parallel arrangement and joined by the arcuate roof portion of the panel.

The floor panel 13 is also a generally rectangular sheet metal member. It is generally horizontally disposed in the assembled mailbox 11 and bent at the opposite sides 29 of the mailbox 11 to provide a pair of depending opposite lateral side edge portions 30. These edge portions 30 are fixed to the opposite lateral side edge portions 28 of the center panel 12 by means of a pair of rivets 31. At the front and rear ends 27 and 26 of the mailbox 11, the panel 13 is also bent to provide front and rear depending side edge portions 32 and 33. The latter is fixed to the rear wall panel 14 by means of a rivet fastener 34, as seen in FIG. 2.

The rear wall panel 14 has an edge portion 36 that generally follows the contour of the bent center panel 12. This edge portion 36 of the rear wall panel 14 is crimped onto the rear edge portion 24 of the center panel 12, as seen in FIG. 2. This provides an elongated bead 37 along the juncture between the panels 12 and 14 and which projects outwardly of the exterior surface 35 of the panel 12 as seen in FIG. 2.

The front edge portion 25 of the center panel 12 is rolled to provide an inwardly projecting bead 38 which in part defines the opening 39 between the interior 40 and the exterior 41 of the mailbox 11. The floor panel 13 has appropriate cutouts (not shown) at the opposite ends of the front side edge portion 32 to accomodate the opposite end portions of the bead 38. The front side edge portions 32 of the floor panel 13 cooperates in this respect with the bead 38 in defining the opening 39.

The door panel 15 generally conforms to the contour of the opening 39 and is stamped to provide a wall strengthening rib 42 and peripheral flange 43 along the opposite side 44 and arcuate upper end 45 of the door panel 15. The arrangement is such that the flange portion 43 of the panel overlies the rolled edge portion 25 of the center panel 12 when the door is positioned to close the opening 39. As seen in FIG. 2, the flange terminates in enlarged sections 46 at the base of the opposite side walls 16 in the assembled mailbox 11. Here the door panel 15 is pivotally connected to the center panel 12 by a pair of aligned rivets 47 that respectively extend through the enlarged flange sections 46 and the adjacent lateral side edge portions 28 and 30 of the center and floor panels 12 and 13. This arrangement provides a pivot axis for the door and which is below the floor 18 of the mailbox 11.

The mailbox enclosure or cover 10 basically includes a generally flat rectangular slat assembly or component 50 that is of sufficient flexibility to be adapted to be draped over the exterior surface 29 of the center panel 12, and a pair of end panel covering components 51 and 52 that are adapted to respectively overlay the exterior surfaces 53 and 54 of the rear wall and door panels 14 and 15 of the mailbox 11.

Figure 5:
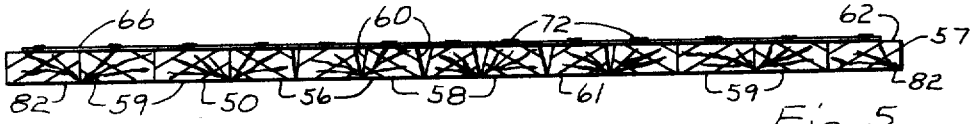
FIG. 5 is a transverse sectional view through the assembly seen in FIG. 4 on a slightly enlarged scale and as taken along the Lines 5—5 therein.
Figure 4:
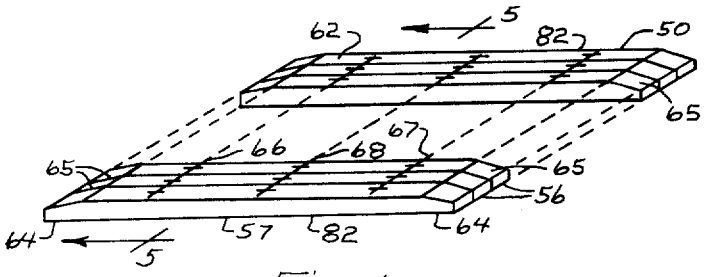
FIG. 4 is an isometric view of the slat assembly of component of the mailbox enclosure with certain parts removed.
Figure 6:
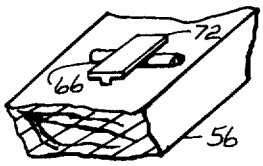
FIG. 6 is an enlarged isometric view of a fragment of one of the slats of the assembly illustrated in FIGS. 4 and 5 and serves to illustrate a means for attaching certain flexible members to the slat.

The structure of the slat assembly 50 is best illustrated in FIGS. 4–6. It includes a plurality of elongated slats 56 which are of substantially equal length. These slats 56 are arranged in parallel and in a row 57 in which each slat is laterally of and adjacent the next slat in the row 57. The row 57 has a center group 58 of slats that are adapted to overlay the arcuate roof portion 19 of the center panel 12 and a pair of opposite end groups 59 that are adapted to overlay the opposite side walls 16 of the center panel 12. The opposite side edges 60 of the slats in the center group 58 are beveled between the exterior and interior side faces 61 and 72 of the assembly 50 and this is done in a manner such that the opposite side edges 60 converge toward the interior side face 62 of the slat assembly. This arrangement permits the confronting side edges of adjacent slats in the group 58 to touch and remain contiguous when the center group of the assembly is draped over the arcuate roof 19 of the panel 12.

The opposite end portions 64 of each slat in the assembly are beveled to provide an endwardly and inwardly inclined surface at the interior side face 62 of the slat assembly. As best seen in FIG. 2, the elongated slats 56 are adapted to extend between the opposite edge portions 24 and 25 of the center panel 12 and the inclined surface arrangement permits the slats to overlay the edge portions 24 and 25 as well as the flange 43 of the door panel 15.

The slats 56 are held together and maintained in position in the assembly by a pair of elongated flexible members 66 and 67 that are located at the opposite ends 70 and 71 of the assembly and yet another flexible member 68 that is located intermediate the opposite ends 70 and 71. These flexible members 66, 67 and 68 are laterally spaced apart and extend transversely of the parallel slats and as thus arranged, each member is joined at the interior side face 62 of the slat assembly 50 to each slat in the assembly by means of staples designated at 72.

The flexible members 66, 67 and 68 may take the form of a length of string, cord or wire which although flexible is nevertheless not extensible. On the other hand, the flexible members 66, 67 and 68 are preferably resiliently extensible in nature and secured to the slat 56 under tension so as to continuously urge the slats together and into a contiguous relation between the side edges of the adjacent slats. For this purpose, suitable lengths of natural or synthetic rubber, nylon or other resiliently deformable material may be used. Nylon is preferred in this respect because of its strength and ability to extend and resiliently recover from the tension forces as such forces are removed.

Figure 7:
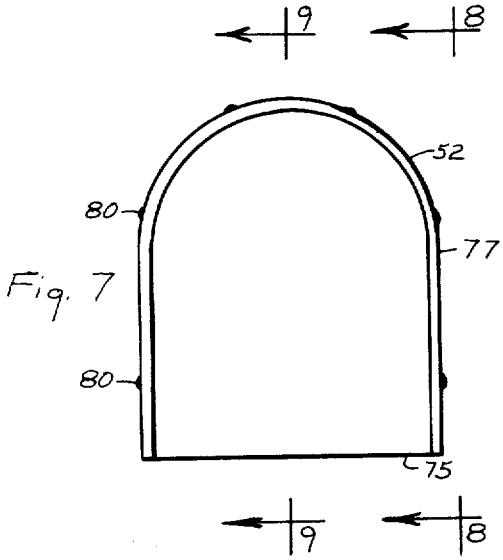
FIG. 7 is a side elevational view of one of the end panel covering components of the mailbox enclosure.
Figure 9:
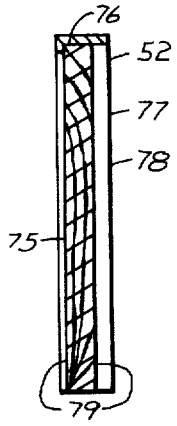
FIG. 9 is a sectional view taken generally along the Lines 9—9 of FIG. 7.
Figure 8:
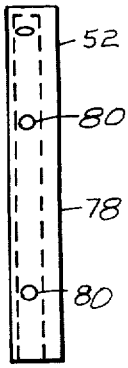
FIG. 8 is a side elevational view taken generally along the Lines 8—8 of FIG. 7.

The cover components 51 and 52 for the end panels 14 and 15 of the mailbox 11 are identical and their structure is best illustrated by reference to FIGS. 7–9 and to the structure of the door panel covering component 52 shown therein. As seen therein, each component has a flat wooden plate 75 which generally conforms to the cross sectional contour of the mailbox 11 but which is nevertheless somewhat enlarged in comparison. This provides a continuous edge 76 for mounting an elongated decorative strip 77 that forms and provides a flange 78 which projects laterally of one of the opposite side faces 79 of the plate 75. This flange 78 in the final assembly of the cover 10 on the mailbox 11 is adapted to overlay the adjacent one of the opposite ends 70 and 71 of the slat assembly. As seen in FIGS. 7–9, the decorative strip 77 is attached to the edge 76 of the plate by small nails 80 that are spaced apart along the strip 77 and extend therethrough and into the edge structure of the plate.

The means by which the slat assembly and cover component of the enclosure 10 are attached and fixed to the mailbox 11 is best illustrated by reference to FIGS. 1 and 2.

Before the components 50–52 are attached, however, the latch mechanism 21 and flag assembly 22 are removed from the mailbox 11 and appropriate holes with grooves referred to hereinafter as used for securing the cover components to the mailbox panels are either punched or drilled through the sheet metal panels of the mailbox.

With the holes provides in the panels and the latch mechanism and flag assembly removed, the slat assembly 50 is draped over the exterior surface 35 of the center panel 12 and so arranged that the opposite end slat members 82 of the assembly 50 overlay the opposite lateral side edge portions 28 of center panel 12. The interior side face 62 of the slat assembly 50 will confront the exterior surface 35 of the center panel 12 when the assembly 50 is thus draped over the center panel and the slat assembly 50 is then fixed to the mailbox 11 at each side wall 16 by means of a pair of screws 83 that extend through the adjacent side edge portions 28 and 30 of the center and floor panels 12 and 13 and into the adjacent end slat member 82 thereat.

As seen in FIG. 2, the opposite end portions 64 of the slats 56 respectively overlay the flange 43 of the door panel 15 and the bead 37 at the rear end of the mailbox 11. At the front end of the mailbox 11, the door panel cover component 51 is fixed to the door panel 15 by means of four screws 84 that extend through the panel 15 and into the plate member 75. When thus secured to the door panel, the flange 78 of the decorative strip 77 overlays the front end 70 of the slat assembly when the door is closed.

The rear wall panel covering component 51 is also attached to the mailbox 11 with four screws 85 that extend through the rear wall panel and into the plate of the component 51. The flange of component 51 in this instance overlays the rear end 70 of the slat assembly. More or less screws than indicated may be used for securing the components 50–52 to the mailbox 11 and, of course, other fastening means may be used if desired.

After the components 50–52 are attached to the mailbox 11, the metal strips 87 and 88 forming the latch mechanism 21 are attached in working alignment to the front face of the door panel covering component by screws 89 and to the top member of the slat assembly by screws 90 as seen in FIGS. 1 and 2. The flat assembly is attached to the slat assembly by means of the original screw components 91 used in securing it to the mailbox 11.

There are several advantages to the mailbox cover arrangement advocated herein. For one, by utilizing a slat arrangement in the assembly covering the center panel, less material (wood in this instance) is used because the slat assembly hugs the center panel as thus draped over the structure. This results in a reduction in raw material costs as compared to the box-like structures heretofore referred to and also results in a weight reduction in the final structure and which enables reduced shipping costs. The arrangement of the slot assembly also permits the component to be folded upon itself and thus into a more compact arrangement for shipping purposes. The slat assembly is admirably suited for projecting the metal panels from contact with airborne objects and presents an exterior appearance which is different enough to be distinguished from the normal box-like mailbox enclosing structures as to be appealing to many members of the purchasing public but not readily duplicated by conventional household tools.

The slats and plate components are preferably made of wood because of the strength and pleasing appearance which would presents but it is conceivable that other materials may also be employed for such structure components. For example, the slats and end plates may be made from plastic materials that have a suitable strength to withstand reasonable impact by airborne objects.

While only a certain preferred embodiment of this invention has been shown and described by way of illustration, many modifications will occur to those skilled in the art and it is, therefore, desired that it be understood that it is intended herein to cover all such modifications that fall within the true spirit and scope of this invention.

What is claimed as new and what it is desired to secure by Letters Patent of the United States is:

1. The combination comprising a rural mailbox having a generally rectangular center panel which has opposite side walls for the mailbox, and a cover for the mailbox comprising a generally rectangular slat assembly that is arranged to overlay the exterior surface of the center panel, said assembly comprising a plurality of elongated slats that are of substantially equal length and arranged to extend between the opposite edge portions of the center panel, said slats being arranged in parallel and in a row with one slat laterally of and adjacent to the next slat in the row, said cover further comprising flexible means located between said slat assembly and said center panel, and means located between said slat assembly and said center panel and joining said flexible means to each of said slats of said assembly, and said combination further comprising means fixing the slat assembly to the mailbox.

2. A cover for a rural mailbox having a generally rectangular center panel which has opposite edge portions and is bent to form an arcuate roof and opposite side walls for the mailbox, said cover comprising a generally rectangular slat assembly that is adapted to overlay the exterior surface of the center panel, said assembly comprising a plurality of elongated slats that are of substantially equal length and adapted to extend between the opposite edge portions of the center panel, said slats being arranged in parallel and in a row with one slat laterally of and adjacent to the next slat in the row, a pair of elongated flexible members which are laterally spaced apart and extend transversely of the parallel slats in the row, and means joining each of said flexible members to each of said slats of said assembly, said flexible members being resiliently extensible.

3. A cover for a rural mailbox having a generally rectangular center panel which has opposite edge portions and is bent to form an arcuate roof and opposite side walls for the mailbox, said cover comprising a generally rectangular slat assembly that is adapted to overlay the exterior surface of the center panel, said assembly comprising a plurality of elongated slats that are of substantially equal length and adapted to extend between the opposite edge portions of the center panel, said slats being arranged in parallel and in a row with one slat laterally of and adjacent to the next slat in the row, a pair of elongated flexible members which are laterally spaced apart and extend transversely of the parallel slats in the row, and means joining each of said flexible members to each of said slats of said assembly, said assembly having an exterior side face and an interior side face, said flexible members being located at the interior side face of the assembly, each of said slats having opposite end portions that are respectively adapted and arranged to overlay the opposite edge portions of the center panel, and each end portion of each slat being beveled to provide an endwardly and inwardly inclined surface at the interior face of the assembly.

4. A cover for a rural mailbox having a generally rectangular center panel which has opposite edge portions and is bent to form an arcuate roof and opposite side walls for the mailbox, said cover comprising a generally rectangular slat assembly that is adapted to overlay the exterior surface of the center panel, said assembly comprising a plurality of elongated slats that are of substantially equal length and adapted to extend between the opposite edge portions of the center panel, said slats being arranged in parallel and in a row with one slat laterally of and adjacent to the next slat in the row, a pair of elongated flexible members which are laterally spaced apart and extend transversely of the parallel slats in the row, and means joining each of said flexible members to each of said slats of said assembly, said row having a group of slats in the center of the row that is adapted and arranged to overlay the arcuate roof formed by the center panel, and each slat in the group having at least one beveled side edge which is contiguous to another slat that is adjacent thereto in the row.

5. A cover for a rural mailbox having a generally rectangular center panel which has opposite edge portions and is bent to form an arcuate roof and opposite side walls for the mailbox, said cover comprising a generally rectangular slat assembly that is adapted to overlay the exterior surface of the center panel, said assembly comprising a plurality of elongated slats that are of substantially equal length and adapted to extend between the opposite edge portions of the center panel, said slats being arranged in parallel and in a row with one slat laterally of and adjacent to the next slat in the row, a pair of elongated flexible members which are laterally spaced apart and extend transversely of the parallel slats in the row, and means joining each of said flexible members to each of said slats of said assembly, said flexible members being resiliently extensible, said assembly having an exterior face and an interior face, said flexible members having opposite end portions that are respectively adapted and arranged to overlay the opposite end portions of the center panel, each end portion of each slat being beveled to provide an endwardly and inwardly inclined surface at the interior face of the assembly, said row having a group of slats in the center of the row that is adapted to overlay the arcuate roof formed by the center panel, and each slat in the group having at least one beveled side edge which is contiguous to a side edge of another slat that is adjacent thereto in the row.

6. A cover for a rural mailbox having a generally rectangular center panel which has opposite lateral side edge portions, a rear edge portion and a front edge portion and which is bent between its lateral side edge portions to provide an arcuate roof and horizontally spaced apart and parallel upright opposite side walls, a generally rectangular and horizontally disposed floor panel which is bent to provide depending opposite side edge portions that are respectively fixed to the lateral side edge portions of the center panel, an upright rear wall panel which has an edge portion that is crimped to the rear edge portion of the center panel and therewith forms an elongated outwardly projecting bead along the crimped juncture between the center panel and rear wall panel, said front edge portion of the center panel being rolled to provide a bead which in part defines an opening between the exterior and interior of the mailbox, a door panel which is pivotally connected to the center panel for pivotal movement in the opening and which has a flange that overlies the rolled front edge portion when the opening is closed by the door panel, said cover comprising a generally flat rectangular assembly that is adapted to overlay the exterior surface of the center panel, said assembly including a plurality of elongated slats that are of substantially equal length and adapted to extend between the front and rear edge portions of the center panel, said slats being arranged in parallel and in a row with one slat laterally of and adjacent to the next slat in the row, a pair of elongated flexible members which are laterally spaced apart and extend transversely of the parallel slats in the row, and means joining each of said flexible members to each of said slats of said assembly, said cover further comprising a pair of flat plates which are respectively adapted to overlay the exterior surface of the rear wall and door panels of the mailbox, each of said plates having and edge and opposite side faces, and each of said plates having a flange forming component that is secured to the plate edge and projects laterally of one of the opposite side faces thereof.

7. A cover for a rural mailbox in accord with claim 6 wherein said flexible members are resiliently extensible.

8. A cover for a rural mailbox in accord with claim 6 wherein said assembly has an exterior side face and an interior side face, said flexible members are located at the interior side face of the assembly, each of said slats has opposite end portions that are respectively adapted and arranged to overlay the opposite edge portions of the center panel, and each end portion of each slat is beveled to provide an endwardly and inwardly inclined surface at the interior face of the assembly.

9. A cover for a rural mailbox in accord with claim 6 wherein said row has a group of slats in the center of the row that is adapted and arranged to overlay the arcuate roof formed by the center panel, and each slat in the group has at least one beveled side edge which is contiguous to another slat that is adjacent thereto in the row.

10. A cover for a rural mailbox in accord with claim 6 wherein said flexible members are resiliently extensible, said assembly has an exterior face and an interior face, said flexible members are located at the interior face of the assembly, each of said slats has opposite end portions that are respectively adapted and arranged to overlay the opposite end portions of the center panel, each end portion of each slat is beveled to provide an endwardly and inwardly inclined surface at the interior face of the assembly, said row has a group of slats in the center of the row that is adapted to overlay the arcuate roof formed by the center panel, and each slat in the group has at least one beveled side edge which is contiguous to a side edge of another slat that is adjacent thereto in the row.

* * * * *